US007500742B2

(12) United States Patent
Parazak et al.

(10) Patent No.: US 7,500,742 B2
(45) Date of Patent: Mar. 10, 2009

(54) SYSTEMS AND METHODS FOR PRINTING ONTO A SUBSTRATE USING REACTIVE INK

(75) Inventors: Dennis P Parazak, Oceanside, CA (US); James A. Mott, San Diego, CA (US); Melissa D. Lee, Escondido, CA (US); James Pingel, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 228 days.

(21) Appl. No.: 10/691,714

(22) Filed: Oct. 22, 2003

(65) Prior Publication Data

US 2005/0088498 A1 Apr. 28, 2005

(51) Int. Cl.
*B41J 2/17* (2006.01)

(52) U.S. Cl. ..... 347/96; 347/100

(58) Field of Classification Search ..... 347/96, 347/100, 101, 95, 54, 44, 47, 62, 45; 523/160; 106/31.27, 31.6, 31.13
See application file for complete search history.

(56) References Cited

U.S. PATENT DOCUMENTS

| | | | | |
|---|---|---|---|---|
| 6,095,636 | A * | 8/2000 | Shioya et al. | 347/43 |
| 6,498,222 | B1 | 12/2002 | Kitamura et al. | |
| 6,533,394 | B1 | 3/2003 | Trunk et al. | |
| 6,540,821 | B2 | 4/2003 | Adamic et al. | |
| 6,557,989 | B1 * | 5/2003 | Hirosawa et al. | 347/87 |
| 2002/0054187 | A1 * | 5/2002 | Kato et al. | 347/100 |
| 2002/0071014 | A1 * | 6/2002 | Matsumoto et al. | 347/87 |
| 2005/0036019 | A1 | 2/2005 | Maekawa | |

FOREIGN PATENT DOCUMENTS

| | | |
|---|---|---|
| EP | 0861832 | 9/1997 |
| EP | 0798120 | 10/1997 |
| JP | 10272827 | 10/1998 |
| JP | 11222568 | 8/1999 |
| JP | 200148934 | 2/2001 |
| JP | 2002103783 | 4/2002 |
| JP | 2003211819 | 7/2003 |
| JP | 2004107648 | 4/2004 |
| JP | 2005014223 | 1/2005 |
| JP | 2005015509 | 1/2005 |
| WO | WO 00/37258 | 6/2000 |

OTHER PUBLICATIONS

EP Search Report, EP04256308 dated May 11, 2007.

* cited by examiner

*Primary Examiner*—Manish S Shah

(57) ABSTRACT

Disclosed herein are method and systems for printing a reactive ink and a fixer or second reactive ink onto a substrate from a single orifice plate, wherein orifice plate comprising at least two orifices; wherein at least one orifice prints a first reactive ink, and other orifice prints a fixer or second reactive ink. The reactive inks and the fixer reacts to form a precipitate which soluble in at least one of the fixer or the inks.

33 Claims, 3 Drawing Sheets

SYSTEMS AND METHODS FOR PRINTING ONTO A SUBSTRATE USING REACTIVE INK

BACKGROUND

Generally, inkjet printers have a print cartridge which comprises an orifice plate having orifices through which droplets of fluid (e.g., ink) are expelled onto a medium (e.g., paper) to create a mark. Ink fluids generally contain colorant(s) which mark the paper by soaking into it. Because the paper absorbs this ink it may be subject to low optical density, low edge acuity, bleeding, and low durability (smudge fastness, light fastness, and water fastness).

One or more of these problems may be solved by the use of reactive inks. Many colorant molecules used in inkjet inks (e.g., dyes or pigments) are negatively charged (anionic) to make them soluble in aqueous vehicles. Generally, to mark a medium using reactive ink, a dye or pigment and a fixer are mixed on the medium. The dye or pigment and fixer react. Reactive inks may utilize a positively charged or cationic species in a separate solution (fixer) to neutralize the colorant on the surface of the medium and render it insoluble. Excess reactants, vehicle, or other reaction products may be absorbed into the medium. The deposited precipitates are no longer excessively water-soluble and this may greatly increase the waterfastness of the print. Resultant prints may also have higher optical density, higher edge acuity, higher durability, less color-to-color bleed, and may be less susceptible to smudging than non-reactive ink systems. Additionally, writing systems using reactive inks may provide print attributes that are less dependent on the properties of the media used.

When using reactive inks it may be advantageous to print the reactants in such a manner that they do not mix and react on, and possibly clog, the printhead. One way to limit the mixing of the reactants on the printheads may be to limit the physical proximity of the nozzles or orifices through which the reactants print. This may be done by printing the reactants from separate printheads having separate orifice plates or from separate orifice plates sharing a common substrate. Printing from separate orifice plates, while possibly alleviating the reaction of the reactants on the printheads, may still be susceptible to deposition of material onto and clogging of the printhead because of the aerosol action of the reactants. Separate printheads and/or orifice plates may also be undesirable because the printheads and orifice plates generally comprise a substantial portion of the cost of printer cartridges, because printer cartridge size is increased, and because two printheads may require more inefficient over-travel (additional distance on each side of the print swath that the carriage must travel in order for the end printhead to complete the printing of a full swath across the media).

To keep costs down and possibly improve efficiency by reducing the amount of over-travel, it may be desirable to print reactive inks from separate nozzles on a single orifice plate on a printhead. However, the closer the proximity of the nozzles which print the reactants, the greater the likelihood of mixing on and possible clogging of the printhead due, not only to aerosol action, but also, for example, to puddling of the liquids during printing or firing, mixing by wiping during printhead servicing, capping during storage, or during application or removal of protective tape from the printhead.

Accordingly, it may be desirable to design a system in which it is possible to print two reactants (e.g., a reactive ink and a fixer) from the same printhead onto a medium (e.g., paper) while minimizing the mixing on the printhead of the reactants and possible clogging of the printhead.

SUMMARY

Disclosed herein are methods and systems for printing a first reactive ink and a fixer or a second reactive ink onto a substrate from a single orifice plate. The first ink and the fixer or second ink react to form a precipitate which is soluble in at least one of the first ink or the fixer or second ink.

BRIEF DESCRIPTION OF THE DRAWINGS

For a detailed description of embodiments of the invention, reference will now be made to the accompanying drawings in which.

NOTATION AND NOMENCLATURE

Certain terms are used throughout the following description and claims to refer to particular system components. As one skilled in the art will appreciate, companies may refer to components by different names. This document does not intend to distinguish between components that differ in name but not function. In the following discussion and in the claims, the terms "including" and "comprising" are used in an open-ended fashion, and thus should be interpreted to mean "including, but not limited to . . . ." Where appropriate, references to inks and dyes are made using the common names as listed in the Color Index (e.g., Acid Blue 9).

DETAILED DESCRIPTION

The following discussion is directed to various embodiments of the invention. The embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Figure 1:
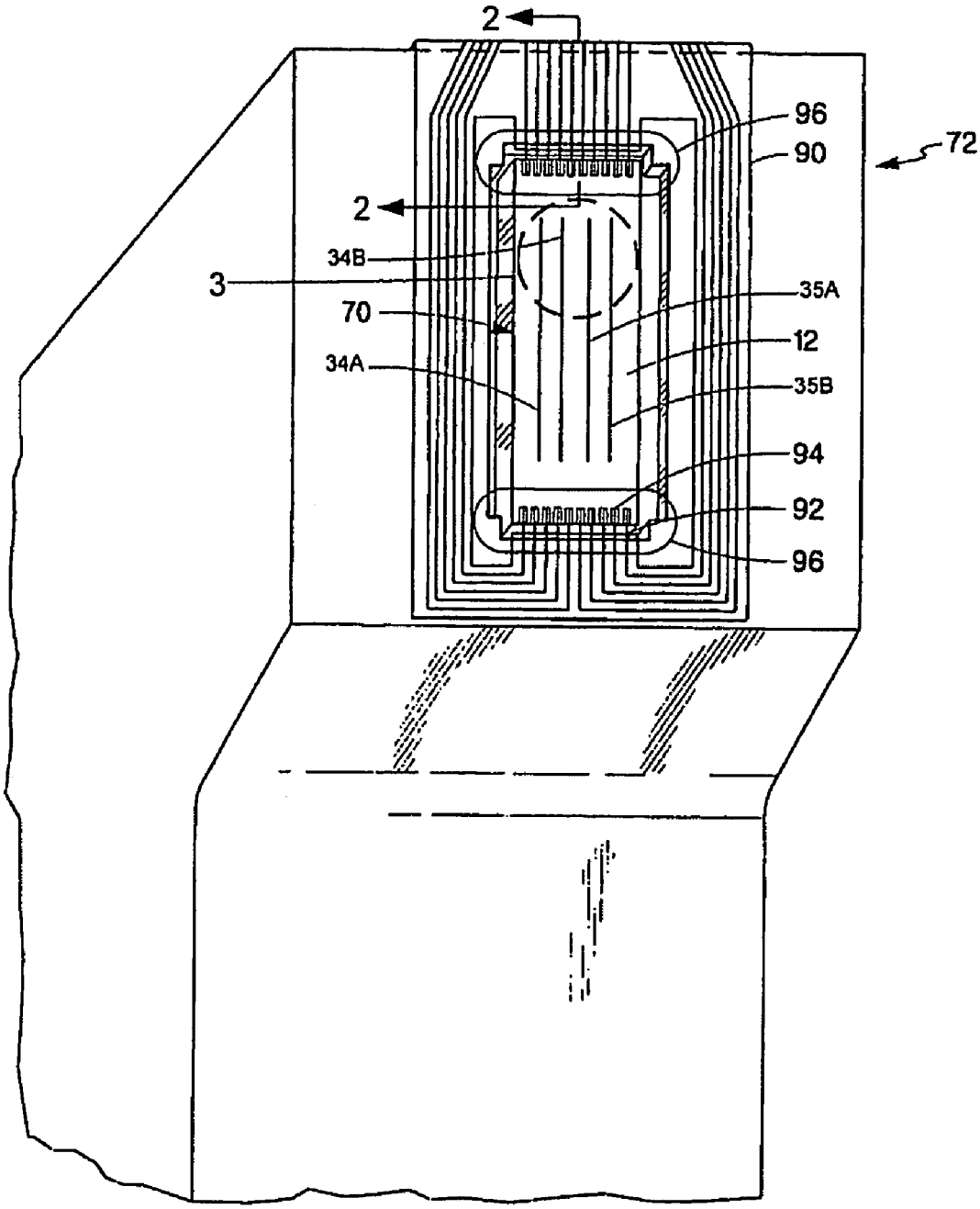
FIG. 1 is a schematic drawing of a print cartridge in accordance with embodiments of the present invention.
Figure 2:
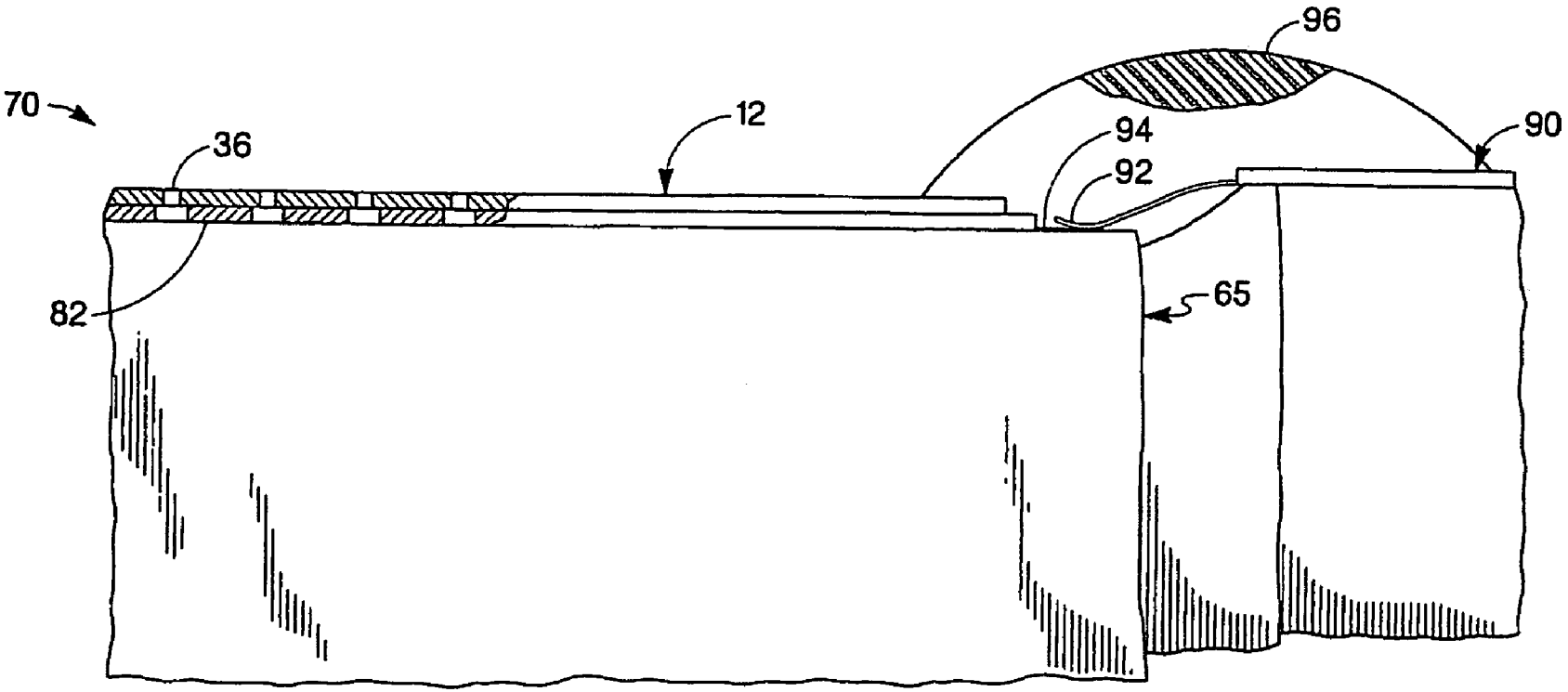
FIG. 2 is a schematic drawing of a portion of the print cartridge in accordance with embodiments of the present invention.

In FIGS. 1 and 2, there is shown a printer cartridge such as that which may be installed into a printer (not shown), which in turn may be controlled by a computer or other electronic device (e.g., digital camera, video camera, cellular phone, PDA). For a brief discussion of the basic operation of an inkjet printer, reference may be made to Shields, James P., "Thermal Inkjet Review, or How Do Dots Get from the Pen to the Page?", Hewlett Packard Journal 67 (August 1992), incorporated herein by reference.

As is shown in FIGS. 1 and 2, the orifice plate 12 may be applied over a barrier layer 82. The barrier layer 82 defines firing chambers that each substantially align with and correspond to the orifices 36 in the plate. Under the barrier layer 82 may be an integrated circuit 65 with arrays of resistors/heating elements corresponding to the firing chambers. The integrated circuit 65, together with the barrier layer and the orifice plate are part of a printhead (or fluid ejection device) 70.

In the embodiments shown in FIG. 1, an inkjet cartridge body (or fluid ejection cartridge) 72 may have a recessed area for receipt of the printhead 70. In the embodiments shown, the printhead 70 is bonded to the cartridge body 72 with structural adhesive. Fluid conduit(s) may be located at a bottom of the recessed area. The conduit conveys fluid (e.g., reactive ink or fixer) from a fluid chamber within the cartridge into a slot in the printhead 70. The slot is in fluid communication with the firing chambers. In some embodiments, the barrier layer 82 may act as a gasket to prevent fluid flow between adjacent orifices. The fluid may be heated in the firing chambers by the resistors and expelled from the corresponding nozzle orifice 36.

As shown in FIGS. 1 and 2, along ends of the printhead 70 may be bond pads 94. In the embodiment shown, there are nineteen bond pads along each end. A circuit element 90 may include conductive tabs 92 that extend to contact with the bond pads 94. The circuit element 90 may electrically couple the printhead with a printer. The printer may, in turn, be coupled with an electronic device.

In some embodiments, an insulating layer 96 may be applied at each end of the printhead. In other embodiments, the insulating layer may be a bead of encapsulant. In yet other embodiments, the layer 96 may be room temperature vulcanizing silicon rubber or a low temperature curing epoxy-based material and may protect the covered elements from corrosion. In some embodiments, the encapsulant may cover the entire length of each end edge as well as extending onto the surface of the plate.

Figure 3:
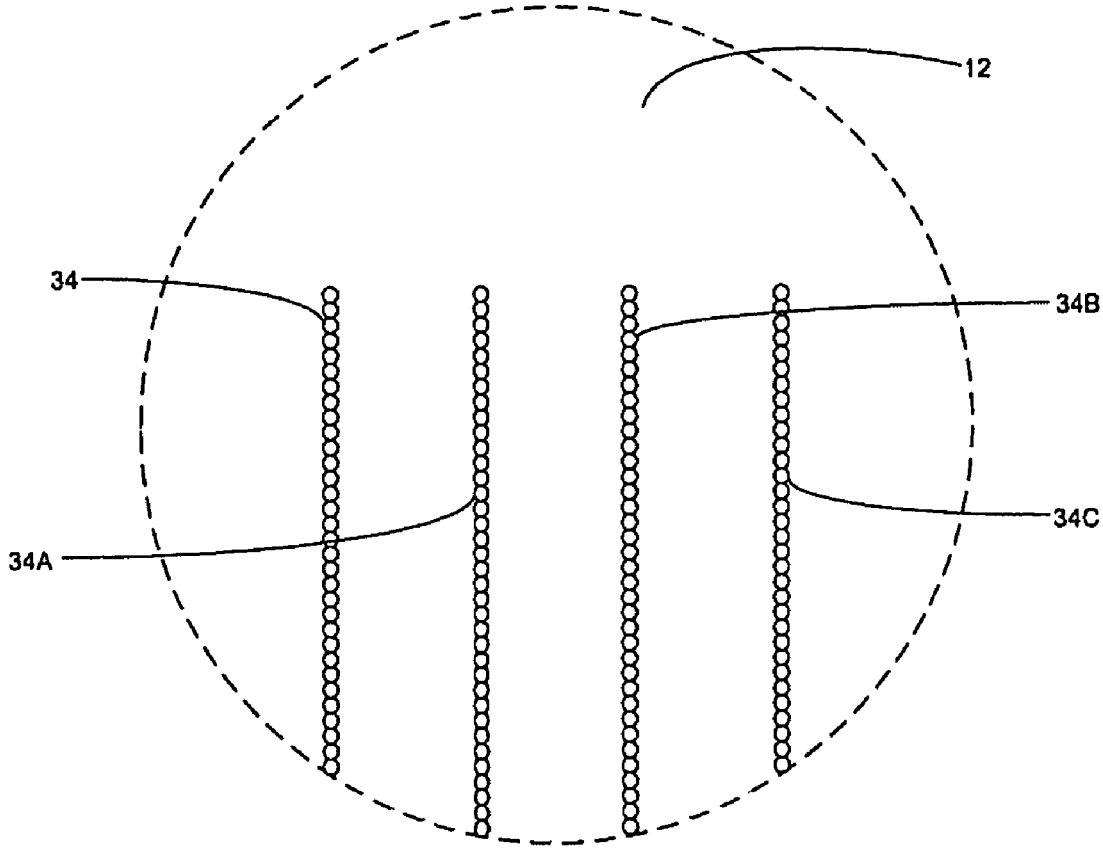
FIG. 3 is a schematic drawing of an expanded view of a portion of the orifice plate of the print cartridge of FIG. 1.

Referring now to FIG. 3, there is shown an expanded view of the area enclosed by circle 2 of FIG. 1. In FIG. 3, there is shown a portion of the orifice plate 12 and arrays of orifices 34A, 34B, 35A, and 35B. Each array (i.e., 34 & 35, each comprising 2 nozzle columns) contains a reactant (i.e., ink or fixer). In a reactive ink system, at least one array of orifices (e.g., array 34) may print a reactive ink (e.g., Acid Blue 9 (Formula 1) or Direct Blue 199 (Formula 2)) and at least one other array (e.g., array 35) may print a fixer (e.g., poly(ethyleneimine) ($H[—NHCH_2CH_2—]_nNH_2$) ("PEI"), poly(diallyldimethylammonium chloride) (Formula 3), poly(dimethylamine-co-epichlorohydrin) ($[—N(CH_3)_2(Cl)CH_2CH(OH)CH_2—]_n$), poly(dimethylamine-co-epichlorohydrin-co-ethylenediamine), imidized poly(styrene-co-maleic anhydride) (Formula 4), polyguanidine (Formula 5), poly(biguanidine) (Formula 6), a polybiguanide such as that of Formula 7 where X and Y are divalent organic linking groups (as described in WO 00/37258), a second reactive ink, or any salts of the foregoing.

(1)

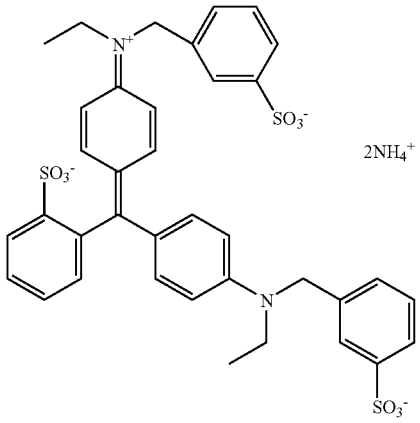

-continued (2)

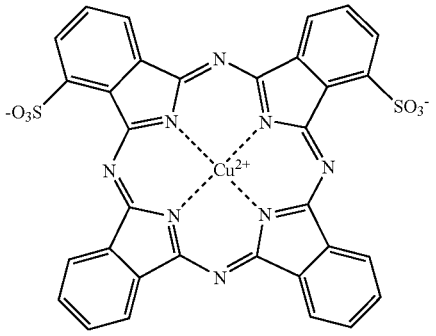

(3)

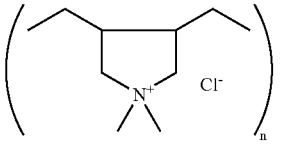

(4)

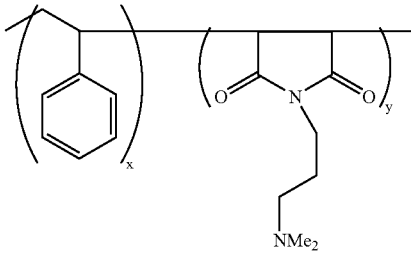

(5)

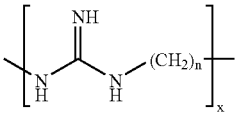

(6)

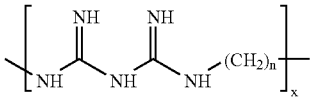

(7)

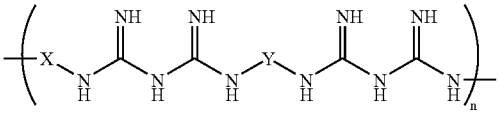

Without being bound by any particular theory, it is believed that in practice, upon mixing on the print medium, the precipitate may be deposited and mark the substrate. Before the precipitate has time to redisperse, the vehicle solvents may be absorbed into the substrate, effectively anchoring the precipitate to the substrate. In contrast, if undesirable precipitates are formed in the nozzles due to cross contamination on the printhead, forces such as fluid shear forces, high temperatures of the firing event, and/or the forces associated with servicing (e.g., wiping, spitting, capping) may agitate the precipitate within the nozzles and cause it to redisperse into the vehicles sufficiently enough that any remaining solids are blown out through the nozzle during subsequent firing events.

EXAMPLES

TABLE 1

Ink Vehicle Formulation (wt %)

| Component | % |
|---|---|
| Alkyl Diol | 12 |
| Heterocyclic Ketone | 6 |
| Secondary Alcohol Ethoxylate | 1 |
| Octyldimethyl Glycine | 2 |
| Polyethylene Glycol | 3 |
| DEA Oleth-3 Phosphate | 0.5 |
| EDTA | 0.1 |
| Sodium Hexadecyl Diphenoxide Disulfonate | 0.5 |
| Deionized Water | 71 |

TABLE 2

Fixer Formulations

| Component | Fixer 1 (wt %) | Fixer 2 (wt %) | Fixer 3 (wt %) | Fixer 4 (wt %) |
|---|---|---|---|---|
| Poly(ethyleneimine) (PEI) | 5 | | 1.25 | 1.25 |
| Poly(biguanidine) | | 1 | .5 | 1.25 |
| Alkyl Diol | 10 | 10 | | |
| Heterocyclic Ketone | 5 | 10 | 15 | 15 |
| Secondary Alcohol Ethoxylate | 0.5 | | | |
| Octane Sulfonate | 0.2 | | | |
| Ethoxylated Alkyne Surfactants | | | 0.8 | 0.8 |
| Fluoro Surfactant | | | 0.1 | 0.1 |
| Calcium Nitrate Hexahydrate | | | | 3 |
| Deionized Water | 79.3 | 79 | 82.35 | 78.6 |
| pH | 4.5 | 4 | 3.4 | 3.5 |

Example 1

A cyan ink was prepared using 3 wt % Color Index (C.I.) Acid Blue 9 in the vehicle of Table 1. A series of ¼" horizontal bars spaced about ½" apart was printed at full density, some with and some without 1 drop/600th inch of underprinted Fixer 1 for every 4 drops/600th inch of cyan ink, on Union Camp Great White paper using an inkjet pen. After 24 hours, 0.25 ml of water was dripped across the series of bars while holding the print sample at a 45-degree angle. The average optical density (OD) of the un-dripped portion of the bar and the average OD transferred to the white space between bars was measured using a densitometer. With respect to the lines printed without Fixer 1, the measured OD was 1.11 OD units and the drip-transfer was 0.230 OD units. With respect to the lines printed using Fixer 1, the OD was 1.01 and the drip transfer was 0.030 OD units. Thus, it was observed that Fixer 1+ Acid Blue 9 ink showed an increase in the print durability with respect to printing made without the fixer.

With respect to resolubilization, four drops of C.I. Acid Blue 9 ink were dropped into a test tube containing approximately 4 g of Fixer 1. A precipitate formed. Upon agitation (e.g., shaking or stirring) of the mixture, the dye/fixer precipitate either dissolved into the vehicle or broke apart and dispersed. The dissolution and/or dispersal may be similar to the effect expected in the nozzle chamber during firing and/or during a servicing routine (i.e., as discussed above, the reliability of the nozzles may be enhanced if the precipitate redissolves or breaks up in the nozzle chambers when they are fired).

Example 2

A cyan ink was prepared using 3 wt % C.I. Direct Blue 199 in the vehicle of Table 1. Print samples were prepared on Union Camp Great White paper as in Example 1 using Fixer 1. After 24 hours, the durability was measured as in Example 1. For marks printed without Fixer 1, the measured OD was 0.98 and the drip transfer was 0.130 OD units, respectively. For marks printed using Fixer 1, the OD was 0.92 and the drip transfer was 0.020 OD units. Thus, Fixer 1 showed substantial increase in the print durability with Direct Blue 199 ink.

With respect to redispersion, four drops of the C.I. Direct Blue 199 ink were dropped into a test tube containing approximately 4 g of Fixer 1. A precipitate formed. The observed precipitate flakes were larger than those observed in the Acid Blue 9/PEI mixture in Example 1. Upon agitation of the mixture, a small portion of the precipitate resolubilized into the vehicle. The agitation caused by firing and/or servicing the nozzle may not dissolve or break apart the dye/fixer complex precipitate as well as Example 1 (possibly due to the planar structure of the Direct Blue 199), which can form a highly crystalline solid which may be unlikely to redissolve even if the PEI charge is neutralized.

Example 3

Four drops of C.I. Acid Blue 9 ink of Example 1 were dropped into a test tube containing approximately 4 g of Fixer 2. A precipitate formed. Upon agitation of the mixture, only a small portion of the precipitate resolubilized into the vehicle. The insoluble precipitate poses the potential to clog the nozzles of the inkjet pen if cross contamination occurs. This fixing agent may form strong complexes with most anionic dyes, independent of pH.

Example 4

Four drops of the C.I. Direct Blue 199 ink as in Example 2 were dropped into a test tube containing approximately 4 g of Fixer 2. A precipitate formed. The observed precipitate flakes were larger than those observed in both the Acid Blue 9/poly (biguanidine) and Direct Blue 199/PEI mixtures. Upon agitation of the mixture, only a small portion of the precipitate resolubilized into the vehicle.

Example 5

A magenta ink was prepared using 3 wt % C.I. Acid Red 52 (Formula 8) in the vehicle of Table 1. Print samples were prepared on Union Camp Great White paper as in Example 1 using Fixer 3. After 24 hours, the durability was measured as in Example 1. With respect to the marks made without Fixer 3, the measured OD was 1.08 and the drip-transfer was 0.200 OD units, respectively. With respect to the marks made using Fixer 3, the OD was 1.01 and the drip-transfer was 0.060 OD units, respectively. Fixer 3+ Acid Red 52 ink showed a substantial increase in the print durability.

(8)

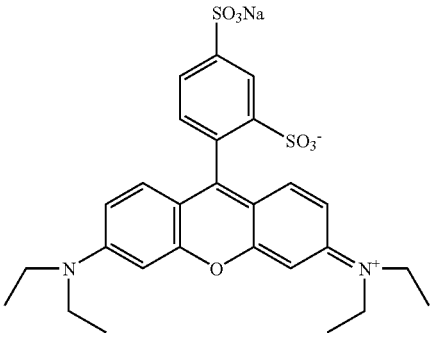

Four drops of Acid Red 52 ink were dropped into a test tube containing approximately 4 g of Fixer 3. A precipitate was formed. Upon agitation (e.g., shaking or stirring) of the mixture, the dye/fixer complex precipitate resolubilized almost completely into the solution. It is hypothesized that a blend of multiple fixing agents may give a balance of print attributes and reliability.

Example 6

Magenta ink was prepared using 3% Ilford M-377 magenta dye (a sulfonated azo-dye available from ILFORD Imaging USA Inc., West 70 Century Road Paramus, N.J. 07652) in the vehicle of Table 1. Print samples were prepared on Union Camp Great White paper as in Example 1 using Fixer 3. After 24 hours, the durability was measured as in Example 1. For marks made without Fixer 3, the measured OD was 0.89 and the drip-transfer was 0.200 OD units, respectively. For marks made using Fixer 3, the OD was 0.81 and the drip-transfer was 0.010 OD units. Thus, Fixer 3+ Ilford M-377 azo-dye ink showed a substantial increase in print durability.

Four drops of Ilford M-377 ink were dropped into a test tube containing approximately 4 g of Fixer 3. A precipitate formed. Upon agitation (e.g., shaking or stirring) of the mixture, all but a small amount of the fine dye/fixer complex precipitate resolubilized into the solution. There was, however, still a significant amount of precipitate.

Another magenta dye that reacts similarly to Ilford M-377 magenta dye, but forms somewhat less precipitate, is the magenta dye of Formula 9 (where Q is a cation) (as described in U.S. Pat. No. 6,540,821, incorporated herein by reference).

(9)

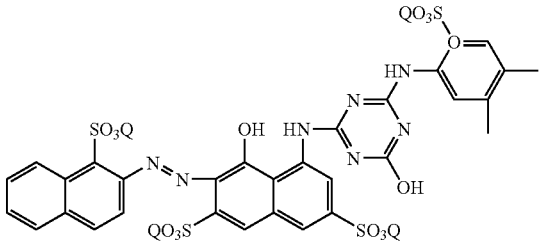

Example 7

Magenta ink was prepared using 3% C.I. Acid Red 289 magenta dye (available from H.W. Sands Corp., 1080 E. Indiantown Rd, Suite 206, Jupiter, Fla. 33477) in the vehicle of Table 1. Print samples were prepared on Union Camp Great White paper as in Example 1 using Fixer 3. After 24 hours, the durability was measured as in Example 1. In marks prepared without Fixer 3, the measured OD was 1.00 and the drip-transfer was 0.240 OD units. In marks prepared using Fixer 3, the OD was 0.98 and the drip-transfer was 0.010 OD units. Fixer 3+ Acid Red 289 dye ink showed a substantial increase in the print durability.

Four drops of the above Acid Red 289 ink were dropped into a test tube containing approximately 4 g of Fixer 3. A chunky precipitate formed. Upon agitation (e.g., shaking or stirring) of the mixture, essentially none of the dye/fixer complex precipitate resolubilized into the solution.

Example 8

Yellow ink was prepared using 3% C.I. Acid Yellow 23 dye (Formula 10) in the vehicle of Table 1. Print samples were prepared on Union Camp Great White paper as in Example 1 using Fixer 2. After 24 hours, the durability was measured as in Example 1. Without Fixer 2, the measured OD was 0.74 and the drip-transfer was 0.120 OD units. Using Fixer 2, the OD was 0.75 and the drip-transfer was 0.060 OD units.

(10)

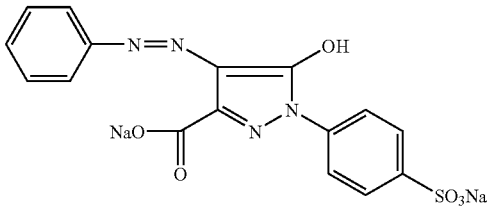

Four drops of Acid Yellow 23 ink were dropped into a test tube containing approximately 4 g of Fixer 2. A precipitate formed. Upon agitation (e.g., shaking or stirring) of the mixture, all of the dye/fixer complex precipitate resolubilized into the solution.

Example 9

Yellow ink was prepared using 3 wt % C.I. Acid Yellow 17 dye (Formula 11) in the vehicle of Table 1. Print samples were prepared on Union Camp Great White paper as in Example 1 using Fixer 2. After 24 hours, the durability was measured as in Example 1. Without Fixer 2, the measured OD was 0.53 and the drip-transfer was 0.070 OD units. Using Fixer 2, the OD was 0.51 and the drip-transfer was 0.020 OD units.

(11)

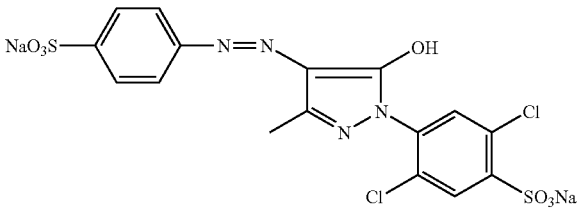

Four drops of Acid Yellow 17 ink were dropped into a test tube containing approximately 4 g of Fixer 2. A precipitate formed. Upon agitation (e.g., shaking or stirring) of the mixture, all of the dye/fixer complex precipitate resolubilized into the solution much like Acid Yellow 23 in Example 8.

Example 10

Yellow ink was prepared using 3% Ilford Y-104 yellow dye (a sulfonated azo-dye available from ILFORD Imaging USA Inc., West 70 Century Road Paramus, N.J. 07652) in the vehicle of Table 1. Print samples were prepared on Union Camp Great White paper as in Example 1 using Fixer 2. After 24 hours, the durability was measured as in Example 1. Without Fixer 2, the measured OD was 0.68 and the drip-transfer was 0.070 OD units. Using Fixer 2, the OD was 0.68 and the drip-transfer was 0.030 OD units. Fixer 2+ Ilford Y-104 yellow dye ink showed an increase in the print durability.

Four drops of the above Ilford Y-104 yellow ink were dropped into a test tube containing approximately 4 g of Fixer 2. A precipitate formed. Upon agitation (e.g., shaking or stirring) of the mixture, most of the dye/fixer complex precipitate resolubilized into the solution, leaving behind a small amount of precipitate. This small amount of persistent precipitate may cause some nozzle clogging of the ink-jet pen when this ink is on the same orifice plate with the fixer and cross-contamination occurs.

Another yellow dye that may behave similarly to Ilford Y-104 is Ilford Y-1189 (Formula 12).

(12)

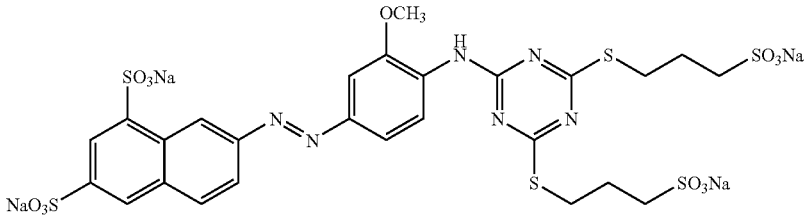

Example 11

Yellow ink was prepared using 3% C.I. Direct Yellow 132 dye (available from H.W. Sands Corp., 1080 E. Indiantown Rd., Suite 206, Jupiter, Fla. 33477) in the vehicle of Table 1. Print samples were prepared on Union Camp Great White paper as in Example 1 using Fixer 2. After 24 hours, the durability was measured as in Example 1. Without Fixer 2, the measured OD was 0.67 and the drip-transfer was 0.070 OD units. Using Fixer 2, the OD was 0.65 and the drip-transfer was 0.00 OD units. Fixer 2+ Direct Yellow 132 dye ink showed an increase in the print durability.

Four drops of C.I. Direct Yellow 132 ink were dropped into a test tube containing approximately 4 g of Fixer 2. Direct Yellow 132 dye and the poly(biguanidine) reacted to form a chunky precipitate. Upon agitation (e.g., shaking or stirring) of the mixture, most of the dye/fixer complex precipitate did not resolublize into the solution, leaving behind a large amount of precipitate.

Another yellow dye that may behave similarly to Direct Yellow 132 is Direct Yellow 86 (available from H. W. Sands Corp., 1080 E. Indiantown Rd., Suite 206, Jupiter, Fla. 33477).

Example 12

Blending dyes that work well (i.e., have high durability and high redispersibility) with those that do not work as well by themselves may also be advantageous and are considered to fall within the scope of embodiments of the present invention. A series of four Yellow inks were prepared using (Y1) 3.50% Acid Yellow 23; (Y2) 2.62% Acid Yellow 23 plus 0.88% Ilford Y-104; (Y3) 1.75% Acid Yellow 23 plus 1.75% Ilford Y-104; and (Y4) 0.88% Acid Yellow 23 plus 2.62% Ilford Y-104 in the vehicle of Table 1. Print samples were prepared on Union Camp Great White paper as in Example 1 with and without Fixer 4. After 24 hours, the durability was measured as in Example 1. Using the fixer substantially increased the durability of the prints. The results are shown in Table 3.

TABLE 3

Durability of Yellow Dye Mixtures

| | Without Fixer 4 | | With Fixer 4 | |
|---|---|---|---|---|
| | OD | OD Transferred | OD | OD Transferred |
| Y1 | 0.65 | 0.15 | 0.64 | 0.01 |
| Y2 | 0.65 | 0.15 | 0.64 | 0.05 |
| Y3 | 0.66 | 0.16 | 0.65 | 0.04 |
| Y4 | 0.67 | 0.14 | 0.67 | 0.03 |

Four drops of Inks Y1-Y4 were dropped into test tubes containing approximately 4 g of Fixer 4. Precipitates were formed in each. Y1 became a hazy liquid while Y2-Y4 showed an increasing amount of an oily precipitate with increasing Ilford Y-104 concentration. Upon agitation (e.g., shaking or stirring) of the mixtures, all of the dye/fixer complex precipitate in Y1 redissolved readily. Most of the precipitate redissolved in Y2 as well. The amount of precipitate remaining after agitation increased from Y2-Y4, but was considerably less than was observed with Direct Yellow 132. Another example of dyes that may be blended is Acid Red 52 and Ilford M-377.

With respect to choosing a reactive ink/fixer combination, several factors may contribute to the redispersibility of the precipitate. For example, inks and fixers which form precipitates with a higher charge density and/or lower molecular weight may tend to more easily redisperse. In contrast, precipitates with strong crystalline structures and those with the most durable print attributes may be more difficult to resolubilize or redisperse. With respect to the choice of fixing agent, generally, precipitates formed with cationic amine polymers (e.g., PEI) may tend to form more easily redispersible precipitates than those formed with quaternary or permanently charged polymers (e.g., polybiguanidine). Factors such as pH of the mixture may also play a role. If the pH of the mixture is too high, some of the fixing agents (e.g., PEI) may lose their positive charge. In some embodiments, the fixing agent may not be a polymer, but a cationic surfactant, such as cetylpyridinium chloride.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A print head comprising: an orifice plate comprising at least two orifices; wherein at least one orifice prints a first reactive ink; wherein at least one other orifice prints a fixer or a second reactive ink; wherein physical proximity of the at least one orifice and the at least one other orifice on the printhead is not limited and mixing of reactants from the at least one orifice and the at least one other orifice is not otherwise prevented or minimized by the printhead; wherein the first reactive ink and the fixer or the second reactive ink react to form a solid precipitate; wherein the solid precipitate is redispersible or redissolvable in at least one of the first reactive ink, or the fixer or the second reactive ink; and wherein, when the solid precipitate forms on the printhead, the solid precipitate is able to redisperse or redissolve, thus avoiding clogging of the printhead.

2. The print head of claim 1 wherein the orifice plate comprises at least two arrays of orifices and wherein one array prints the reactive ink and wherein another array prints the fixer or the second reactive ink.

3. The print head of claim 1 wherein the at least one other orifice prints a fixer and the fixer comprises a positively charged species.

4. The print head of claim 1 wherein the positively charged species is a polymer.

5. The print head of claim 4 wherein the fixer is selected from the group consisting of poly(ethyleneimine), polyguanidines, poly(diallyldimethylammonium chloride), poly(dimethylamine-co-ethylenediamine), imidized poly (styrene-co-maleic anhydride), polyguanides, and salts thereof.

6. The print head of claim 5 wherein the fixer comprises polyethyleneimine and poly(biguanidine) or salts thereof.

7. The print head of claim 1 wherein the printing is controlled by an electronic device.

8. The print head of claim 1 wherein the reactive ink comprises at least two dyes.

9. An orifice plate for a print head, the orifice plate comprising: at least two orifices; wherein at least one orifice prints a ink; wherein the second orifice prints at least one of a fixing agent or a second ink; wherein physical proximity of the at least one orifice and the at least one other orifice on the printhead is not limited and mixing of reactants from the at least one orifice and the at least one other orifice is not otherwise prevented or minimized by the printhead; wherein the ink and the at least one of the fixing agent or the second ink react to form a precipitate; wherein the precipitate is redispersible in at least one of the first ink or the at least one of the fixing agent or the second ink; and wherein, when the precipitate forms on the printhead, the precipitate is able to redisperse or redissolve, thus avoiding clogging of the printhead.

10. The orifice plate of claim 9 comprising at least two arrays of orifices and wherein one array prints the first ink and wherein another array prints the at least one of the fixing agent or the second ink.

11. The orifice plate of claim 9 wherein the second orifice prints the fixing agent and the fixing agent comprises a positively charged species.

12. The orifice plate of claim 11 wherein the positively charged species comprises a polymer.

13. The orifice plate of claim 11 wherein the positively charged species comprises poly(ethyleneimine), polyguanidines, poly(diallyldimethylammonium chloride), poly(dimethylamine-co-ethylenediamine), imidized poly (styrene-co-maleic anhydride), polyguanides, and salts thereof.

14. The orifice plate of claim 13 wherein the fixing agent comprises polyethyleneimine and poly(biguanidine) or salts thereof.

15. The orifice plate of claim 9 wherein the printing is controlled by an electronic device.

16. The orifice plate of claim 9 wherein the reactive ink comprises at least two dyes.

17. A method for marking a medium, the method comprising: printing with a printhead at least one of a fixer or first reactive ink onto the medium; and printing with the printhead a second reactive ink onto the medium; wherein the at least one of the fixer or first reactive ink and the second reactive ink react to deposit a precipitate onto the medium; wherein the precipitate is redispersible or redissolvable in the at least one of the fixer or first reactive ink or the second reactive ink; and wherein the second reactive ink and the at least one of the fixer or the first reactive ink are printed from the same orifice plate; wherein physical proximity of the at least one orifice and the at least one other orifice on the printhead is not limited and mixing of reactants from the at least one orifice and the at least one other orifice is not otherwise prevented or minimized by the printhead; and wherein, when the solid precipitate forms on the printhead, the solid precipitate is able to redisperse or redissolve, thus avoiding clogging of the printhead.

18. The method of claim 17 wherein the orifice plate comprises at least two arrays of orifices and wherein one array prints the second reactive ink and wherein another array prints the fixer or the first reactive ink.

19. The method of claim 17 wherein the fixer comprises a positively charged species.

20. The method of claim 19 wherein the fixer comprises a polymer.

21. The method of claim 19 wherein the fixer comprises poly(ethyleneimine), polyguanidines, poly(diallyldimethylammonium chloride), poly(dimethylamine-co-ethylenediamine), imidized poly(styrene-co-maleic anhydride), polyguanides, and salts thereof.

22. The method of claim 21 wherein the fixer comprises polyethyleneimine and poly(biguanidine) or salts thereof.

23. The method of claim 17 wherein the printing is controlled by an electronic device.

24. The method of claim 17 wherein the reactive ink comprises at least two dyes.

25. A means for marking a substrate, the means comprising: a means for depositing a reactive ink which includes a colorant onto the substrate; and a means for depositing a fixer which includes a fixing agent onto the substrate; wherein the colorant and the fixing agent are deposited through the same orifice plate; wherein physical proximity of the at least one orifice and the at least one other orifice is not limited and mixing of reactants from the at least one orifice and the at least one other orifice is not otherwise prevented or minimized by the means for marking a substrate; wherein the colorant and the fixing agent react to mark the substrate with a precipitate; and wherein the precipitate is redispersible or redissolvable in at least one of the reactive ink which includes the colorant or the fixer which includes the fixing agent; and wherein, when the solid precipitate forms on the means for marking a substrate, the solid precipitate is able to redisperse or redissolve, thus avoiding clogging of the means for marking a substrate.

26. The means of claim 25 wherein the orifice plate comprises at least two arrays of orifices and wherein one array prints the colorant and wherein another array prints the fixing agent.

27. The means of claim 25 wherein the fixing agent is a positively charged species.

28. The means of claim 27 wherein the fixing agent comprises a polymer.

29. The means of claim 27 wherein the fixing agent comprises poly(ethyleneimine), polyguanidines, poly(diallyldimethylammonium chloride), poly(dimethylamine-co-ethylenediamine), imidized poly(styrene-co-maleic anhydride), polyguanides, and salts thereof.

30. The means of claim 29 wherein the fixing agent comprises polyethyleneimine and poly(biguanidine) or salts thereof.

31. The means of claim 25 wherein the means for marking is controlled by an electronic device.

32. The means of claim 25 wherein the reactive ink comprises at least two dyes.

33. A print head comprising: an orifice plate comprising at least two orifices; wherein at least one orifice prints a first reactive ink; wherein at least one other orifice prints a fixer or a second reactive ink; wherein physical proximity of the at least one orifice and the at least one other orifice on the printhead is not limited and mixing of reactants from the at least one orifice and the at least one other orifice is not otherwise prevented or minimized by the printhead; wherein the first reactive ink and the fixer or the second reactive ink react to form a solid precipitate; and wherein, when the solid precipitate forms in one of the at least one orifice or the least one other orifice, the solid precipitate is redispersible or redissolvable in the at least one orifice or the at least one other orifice in at least one of the first reactive ink, or the fixer or the second reactive ink; and wherein, when the solid precipitate forms on the printhead, the solid precipitate is able to redisperse or redissolve, thus avoiding clogging of the printhead.

* * * * *